US010736202B2

(12) United States Patent
Magielse et al.

(10) Patent No.: US 10,736,202 B2
(45) Date of Patent: Aug. 4, 2020

(54) LIGHTING CONTROL

(71) Applicant: SIGNIFY HOLDING B.V., Eindhoven (NL)

(72) Inventors: Remco Magielse, Tilburg (NL); Dzmitry Viktorovich Aliakseyeu, Eindhoven (NL); Bas Driesen, Weert (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/475,801

(22) PCT Filed: Dec. 14, 2017

(86) PCT No.: PCT/EP2017/082903

§ 371 (c)(1),
(2) Date: Jul. 3, 2019

(87) PCT Pub. No.: WO2018/127378

PCT Pub. Date: Jul. 12, 2018

(65) Prior Publication Data

US 2019/0357338 A1 Nov. 21, 2019

(30) Foreign Application Priority Data

Jan. 4, 2017 (EP) ..... 17150277

(51) Int. Cl.
*H05B 37/02* (2006.01)
*H05B 47/19* (2020.01)
(Continued)

(52) U.S. Cl.
CPC ..... *H05B 47/19* (2020.01); *H05B 45/10* (2020.01); *H05B 45/14* (2020.01); *H05B 45/20* (2020.01); *H05B 45/24* (2020.01); *H05B 47/175* (2020.01)

(58) Field of Classification Search
None
See application file for complete search history.

(56) References Cited

U.S. PATENT DOCUMENTS 8,565,905 B2 10/2013 Engelen
10,045,425 B2 * 8/2018 Rozendaal ..... A63F 13/216
(Continued)

FOREIGN PATENT DOCUMENTS

WO 2010070517 A1 6/2010
WO 2012148385 A1 11/2012
(Continued)

*Primary Examiner* — Vibol Tan
(74) *Attorney, Agent, or Firm* — Meenakshy Chakravorty

(57) ABSTRACT

A method of controlling a luminaire at a first physical location in a physical space to render a lighting effect in the physical space, the method being performed by a control device and comprising steps of: receiving at least one data object for use in rendering the lighting effect, the data object defining at least one virtual object comprising an influence value for the virtual object and a coordinate vector denoting a virtual location of the virtual object in a virtual space; determining the first physical location of the luminaire in the physical space from a map of the physical space; determining a separation between the first physical location of the luminaire and a second physical location in the physical space corresponding to the virtual location of the virtual object in the virtual space; and controlling at least one characteristic of light emitted by the luminaire as a function of the determined separation and the influence value for the virtual object, thereby rendering the lighting effect.

15 Claims, 18 Drawing Sheets

(51) Int. Cl.

| | |
|---|---|
| ***H05B 45/14*** | (2020.01) |
| ***H05B 47/175*** | (2020.01) |
| ***H05B 45/20*** | (2020.01) |
| ***H05B 45/24*** | (2020.01) |
| ***H05B 45/10*** | (2020.01) |

(56) References Cited

U.S. PATENT DOCUMENTS

| | | | | |
|---|---|---|---|---|
| 10,187,963 | B2 * | 1/2019 | Van De Sluis | H05B 33/0863 |
| 10,375,800 | B2 * | 8/2019 | Deixler | H05B 33/0863 |
| 10,390,411 | B2 * | 8/2019 | Tiberi | H05B 37/0227 |
| 10,448,006 | B2 * | 10/2019 | Caicedo Fernandez | G07C 9/00 |
| 10,455,666 | B2 * | 10/2019 | Magielse | H05B 37/0245 |
| 10,465,882 | B2 * | 11/2019 | Engelen | G06F 3/04847 |
| 10,477,653 | B2 * | 11/2019 | Krajnc | H05B 33/086 |
| 10,485,074 | B2 * | 11/2019 | Mason | G09G 3/3413 |
| 10,492,274 | B2 * | 11/2019 | De Bruijn | H05B 37/029 |
| 2005/0248299 | A1 | 11/2005 | Chemel et al. | |
| 2011/0109250 | A1 | 5/2011 | Engelen | |
| 2015/0351204 | A1 | 12/2015 | Hershberg et al. | |
| 2016/0044766 | A1 | 2/2016 | Alexander et al. | |
| 2018/0098408 | A1 * | 4/2018 | Hubbers | H05B 47/155 |
| 2018/0190024 | A1 * | 7/2018 | Dugan | G06T 19/006 |
| 2019/0188450 | A1 * | 6/2019 | Spivack | G06K 9/00671 |

FOREIGN PATENT DOCUMENTS

| | | | |
|---|---|---|---|
| WO | 2014073972 | A2 | 5/2014 |
| WO | 2015095645 | A1 | 6/2015 |

* cited by examiner

| Light Script | | | |
|---|---|---|---|
| Virtual Object | Virtual Location | Influence Value | Light Effect |
| S1 | (3,13) | 3.5 | Blue |
| S2 | (13,13) | 3.5 | Red |
| S3 | (3,4) | 5.8 | Yellow |
| S4 | (13,4) | 5.8 | Green |

| Infrastructure Map | |
|---|---|
| Luminaire | Physical Location |
| A | (4,15) |
| B | (13,15) |
| C | (1,13) |
| D | (8,9) |
| E | (1,3) |
| F | (15,3) |

| | S1 | S2 | S3 | S4 |
|---|---|---|---|---|
| A | 2.24 | 9.22 | 11.05 | 14.21 |
| B | 10.20 | 2.00 | 14.87 | 11.00 |
| C | 2.00 | 12.00 | 9.22 | 15.00 |
| D | 6.40 | 6.40 | 7.07 | 7.07 |
| E | 10.20 | 15.62 | 2.24 | 12.04 |
| F | 15.62 | 10.20 | 12.04 | 2.24 |

LIGHTING CONTROL

CROSS-REFERENCE TO PRIOR APPLICATIONS

This application is the U.S. National Phase application under 35 U.S.C. § 371 of International Application No. PCT/EP2017/082903, filed on Dec. 14, 2017, which claims the benefit of European Patent Application No. 17150227.1, filed on Jan. 4, 2017. These applications are hereby incorporated by reference herein.

TECHNICAL FIELD

The present disclosure relates to systems and methods for controlling luminaires, i.e. lighting devices, to render a lighting effect a physical space.

BACKGROUND

Electronic devices are becoming ever more connected. A "connected" device refers to a device—such as a user terminal, or home or office appliance or the like—that is connected to one or more other such devices via a wireless or wired connection in order allow more possibilities for control of the device. For instance, the device in question is often connected to the one or more other devices as part of a wired or wireless network, such as a Wi-Fi, ZigBee or Bluetooth network. The connection may for example allow control of the device from one of the one or more other devices, e.g. from an app (application) running on a user device such as a smart phone, tablet or laptop; and/or may allow for sharing of sensor information or other data between the devices in order to provide more intelligent and/or distributed automated control.

In recent years, the number of connected devices has increased dramatically. Lighting systems are part of this movement towards a connected infrastructure. Conventional connected lighting systems consist of fixed light sources, which can be controlled through wall-mounted switches, dimmers or more advanced control panels that have pre-programmed settings and effects, or even from an app running on a user terminal such as a smart phone, tablet or laptop. For example, this may allow user to create an ambiance using a wide range of colored lighting, dimming options and/or dynamic effects. In terms of control the most common approach is to replace a light switch with a smart-phone based app that offers extended control over lighting (for example Philips hue, LIFX, etc.).

A lighting scene is a particular overall lighting effect in an environment rendered by the light sources in that environment. E.g. a "sunset" scene may be defined in which the light sources are set to output hues in the red-yellow range of the visible spectrum. Each light source may for example output the different hues (or other setting such as saturation or intensity), or a scene may be rendered by all (or some) lights rendering a single color or similar colors. Note that lighting scenes may be dynamic in that the output of one or more light source changes over time.

Connected lighting systems are able to render lighting scenes by receiving lighting instructions over the network (e.g. a ZigBee network) from, for example, a user device such as a smart phone, and interpret the lighting instructions in order to determine the appropriate lighting settings for each light source in order that the lighting system renders a desired lighting scene in the environment.

When a user of a lighting system (e.g. his own lighting system deployed in his home) wishes to render a lighting scene, he can select (using a user device such as a smart phone) a predefined lighting scene which specifies respective lighting settings for each luminaire in the system. This predefined lighting scene may have been designed by the user at an earlier time and stored to memory (e.g. n the user device) for rendering. In recent years however, it has become possible for a user to retrieve lighting scenes from a third party source (e.g. over the Internet) which were designed by a person other than the user himself.

SUMMARY

Connected lighting systems can be used to render light effect which can enhance many forms of entertainment; music, movies, or gaming experiences etc. A user may wish to render an external lighting scene (i.e. a lighting scene which was defined by a different user) in his personal lighting system. However, the different user may not have designed the lighting scene with the user's lighting system in mind and therefore mapping lighting content of the scene to the actual setup of the user using it may be difficult, as setups may differ.

Specifically, one difficulty with rendering light effects in a complete room is that the setup of light points differs between homes. There is no universal setup and lighting content created for one setup may not render nicely, or may not render at all on other setups. The present invention provides a mechanism that allows content creators to define lighting effects without foresight of any particular lighting system setup on which it is to be rendered. The lighting effect(s) can for example be embodied in a lighting script, to be rendered by a controller, where the controller (rather than the context creator) takes into account the lighting system setup automatically.

The present invention solves this problem by using "virtual object(s)" which are defined independently of a particular lighting system to determine settings for a particular luminaire. A virtual object is an entity defined by its location in a virtual space and the extent to which it influences its surroundings (influence value). To render a lighting effect, a separation in physical space between a luminaire and a location corresponding to the virtual object is determined, and light emitted by the luminaire is set as a function of the separation and the influence value.

Conceptually, it can be useful to think of this as the virtual object exerting an effect on the luminaire that is comparable to a "gravitational pull", where the influence value acts to some extent as a "mass" of the virtual object, determining the strength of its gravitational pull.

Hence, according to a first aspect disclosed herein there is provided a method of controlling a luminaire at a first physical location in a physical space to render a lighting effect in the physical space, the method being performed by a control device and comprising steps of: receiving at least one data object for use in rendering the lighting effect, the data object defining at least one virtual object comprising an influence value for the virtual object and a coordinate vector denoting a virtual location of the virtual object in a virtual space; determining the first physical location of the luminaire in the physical space from a map of the physical space; determining a separation between the first physical location of the luminaire and a second physical location in the physical space corresponding to the virtual location of the virtual object in the virtual space; and controlling at least one characteristic of light emitted by the luminaire as a function of the determined separation and the influence value for the virtual object, thereby rendering the lighting effect.

In embodiments, the method further comprises a step of mapping the virtual location denoted by the coordinate vector of the virtual object to the second physical location within the physical space.

In embodiments, the influence value is an influence radius and said function varies between a maximum at zero separation and zero at separation equal to the influence radius.

In embodiments, said at least one characteristic is one or more of a brightness or saturation of the light emitted by the luminaire.

In embodiments, the data object defines: a first virtual object comprising a first influence value for the first virtual object and a first coordinate vector denoting a first virtual location of the first virtual object in a virtual space; and a second virtual object comprising a second influence value for the second virtual object and a second coordinate vector denoting a second virtual location of the second virtual object in the virtual space.

In embodiments, said determining a separation comprises determining a respective separation for each of the first and second virtual objects; and said controlling is performed as a function of the determined separations, the first influence value, and the second influence value.

In embodiments, the method further comprises a step of determining a winning virtual object according to a predetermined rule; and wherein said controlling is performed based only on the respective separation and influence value for the winning virtual object.

In embodiments, wherein the predetermined rule is that the winning virtual object is a one of the first and second virtual objects having a highest function value at the physical location of the luminaire.

In embodiments, the predetermined rule is that the winning virtual object is a one of the first and second virtual objects having the highest respective influence value.

In embodiments, the at least one characteristic is at least one of a brightness, saturation, hue, or timing of a dynamic effect.

In embodiments, the method further comprises a step of performing the method steps to control at least one further luminaire at a respective further physical location in the physical space to render a further lighting effect in the physical space.

In embodiments, wherein the at least one characteristic is varied based on number of luminaires within range of the virtual source.

According to a second aspect disclosed herein, there is provided a control device for controlling a luminaire at a first physical location in a physical space to render a lighting effect in the physical space, the control device comprising: an output for sending control commands to the luminaire; a first input for receiving at least one data object for use in rendering the lighting effect, the data object defining at least one virtual object comprising an influence value for the virtual object and a coordinate vector denoting a virtual location of the virtual object in a virtual space; and a processor arranged to: determine the first physical location of the luminaire in the physical space from a map of the physical space; determine a separation between the first physical location of the luminaire and a second physical location in the physical space corresponding to the virtual location of the virtual object in the virtual space; and control, via the output at least one characteristic of light emitted by the luminaire as a function of the determined separation and the influence value for the virtual object, thereby rendering the lighting effect.

According to a third aspect disclosed herein, there is provided a lighting system comprising the control device of the second aspect and the luminaire.

According to a fourth aspect disclosed herein, there is provided a computer program product comprising computer-executable code embodied on a computer-readable storage medium arranged so as when executed by one or more processing units to perform the method according to the first aspect.

According to another aspect disclosed herein, there is provided a method of controlling a luminaire at a first location in a space, the luminaire arranges for illuminating the space, the method being performed by a control device and comprising steps of: receiving at least one data object for use in rendering a lighting effect, the data object comprising a location value and a range value; determining the first location of the luminaire in the space; determining a separation between a second location in the space corresponding to the location value in the data object and the first location of the luminaire, wherein the second location is different from the first location; and controlling at least one characteristic of light emitted by the luminaire as a function of the determined separation and the range value, thereby rendering the lighting effect.

BRIEF DESCRIPTION OF THE DRAWINGS

To assist understanding of the present disclosure and to show how embodiments may be put into effect, reference is made by way of example to the accompanying drawings in which.

DETAILED DESCRIPTION OF EMBODIMENTS

Figure 1:
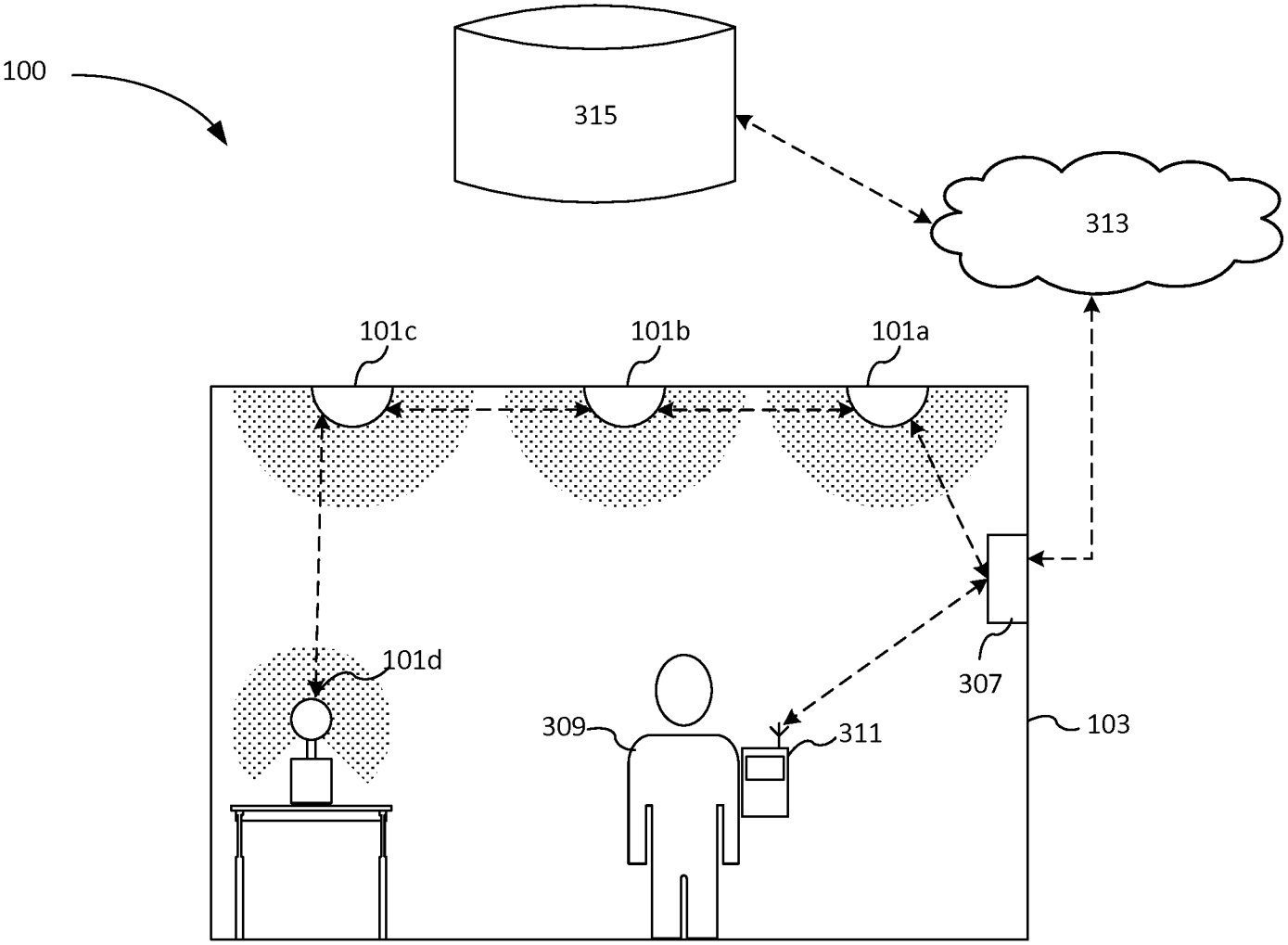
FIG. 1 shows a system according to embodiments of the present invention.

Described embodiments relate to rendering a lighting scene by a connected lighting system, the scene being specified by a light or lighting script. The light script (the content of the lighting scene) comprises one or more virtual objects (virtual sources of lighting effects) within a virtual space, and luminaires of the system which exist in a physical (real-world) space can be associated with virtual objects to determine their lighting setting in a manner analogous to a "gravitational model". In a simple example, each virtual object is associated with an influence range which defines a respective area/volume. Luminaires within that area/volume are then influenced by that virtual object. The influence range may be considered a "pull" factor, which "draws in" a nearby luminaire and sets it to the light state of that area, in an analogous way to the Gravitational Force. In the simplest case, the influence range can be defined by a single influence value, that defines an influence range corresponding to a circle or sphere about the virtual object. To extend this, multiple influence values can define influence ranges corresponding to more complex areas/volumes of space.

In other words, an external or third party user can define a lighting scene by way of a lighting script which defines an abstract (virtual) space. The lighting script comprises one or more data objects, each of which defines a virtual object at a location in the space. Thus, this allows the scene to be defined without the need to tie it to any particular lighting system setup. The lighting script can then be applied to a user's lighting system by mapping the abstract space of the lighting script to the real-world environment the user wishes to render it in, and determining the influence of each data object on each real-world luminaire in the user's system. This model advantageously separates content creation from actual application.

In the simplest case, the data object consists of a coordinate vector denoting a location of the virtual object and at least one influence value which defines the extent to which the virtual object influences luminaires in its vicinity. That is, the term "data object" refers to the underlying data structure that defines a virtual object. Note, for conciseness, the description sometimes uses the term "virtual object" in reference to the underlying data; it will be clear in context what is meant.

In a simple example, the distance to every luminaire is computed for every virtual object source location. If the distance to the luminaire is smaller than the pull factor (influence value/range) the light is "attracted to" the light state that belongs to that source. This distance may be computed in a 2-dimensional or 3-dimensional space. That luminaire is then controlled according to the light state of that virtual object.

For ease of understanding, the following first describes a generic lighting system in accordance with embodiments of the present invention, and then subsequently describes methods and controllers according to the present invention which may be implemented by and in the lighting system.

FIG. 1 shows a lighting system 100 according to embodiments of the present invention. An environment 103 (a physical, real-world, space) contains a plurality of luminaires 101*a-d*. Luminaires 101*a-c* are ceiling type luminaires designed to provide illumination in the environment 103 from above. Luminaire 101*d* is a free-standing lamp type luminaire placed on a table designed to provide illumination in the environment 103 from a lower position than the ceiling type luminaires 101*a-c*. Each of the luminaires 101*a-d* may be any suitable type of luminaire such as an incandescent light, a fluorescent light, an LED lighting device etc. The plurality of luminaires 101*a-d* may comprise more than one type of luminaire, or each luminaire 101*a-d* may be of the same type. Each of the luminaires comprises at least one illumination source.

The plurality of luminaires 101*a-d* along with a lighting bridge 307 form a connected lighting network controllable be at least one control device (e.g. user device). There may also be one or more switches and/or one or more sensors present as part of the connected system, as in known in the art but not shown in FIG. 1. The devices are all interconnected by wired and/or wireless connections, indicated by dotted lines in FIG. 1. In particular, FIG. 1 shows "chaining" connections such as may be implemented in a ZigBee lighting network, wherein it is not necessary for each device to be directly connected to each other device. Instead, devices are able to relay communication signals which allows for, for example, luminaire 101*c* to communicate with the lighting bridge 307 by relaying data through luminaires 101*b* and 101*a* to lighting bridge 307. However, it is not excluded that other network topologies may be employed. For example, a "hub-and-spoke" topology may be used in which each device is directly connected (e.g. wirelessly) to the lighting bridge 307 and not to any other devices in the network.

Note that connected lighting systems exist which do not comprise a lighting bridge as described above. In these cases lighting control commands may be provided directly to each luminaire (i.e. instead of via a bridge). What is important is that a connected lighting system comprises luminaires which can communicate with a control device (e.g. a user device) and therefore be controlled. The luminaires may or may not be able to communicate with each other.

Lighting bridge 307 is arranged at least to send lighting control commands to luminaires 101*a-d*.

FIG. 1 also shows a user 309 and user device 311 such as a smart phone. The user device 311 is operatively coupled to the lighting bridge 307 by a wired or wireless connection (e.g. WiFi or ZigBee) and hence forms part of the lighting network. User 309 can provide user input to the lighting bridge 307 via the user device 311 using, for example, a graphical user interface of the user device 311. The lighting bridge 307 then interprets the user input and sends control commands to the luminaires 101*a-d* accordingly. As mentioned above, the user device 311 generally allows for more complex control than a traditional light switch. For example, the user 309 may use the user device 311 to control an individual luminaire.

As illustrated in FIG. 1, lighting bridge 307 may also be provided with a wide area network (WAN) connection such as a connection to the internet 313. This connection, as known in the art, allows the lighting bridge 307 to connect to external data and services such as memory 315. Note that the wireless connection between user device 311 and the lighting bridge 307 is shown in FIG. 1 as a direct connection, but it is understood that the user device 311 may also connect to the lighting bridge 307 via the Internet 313.

Figure 2A:
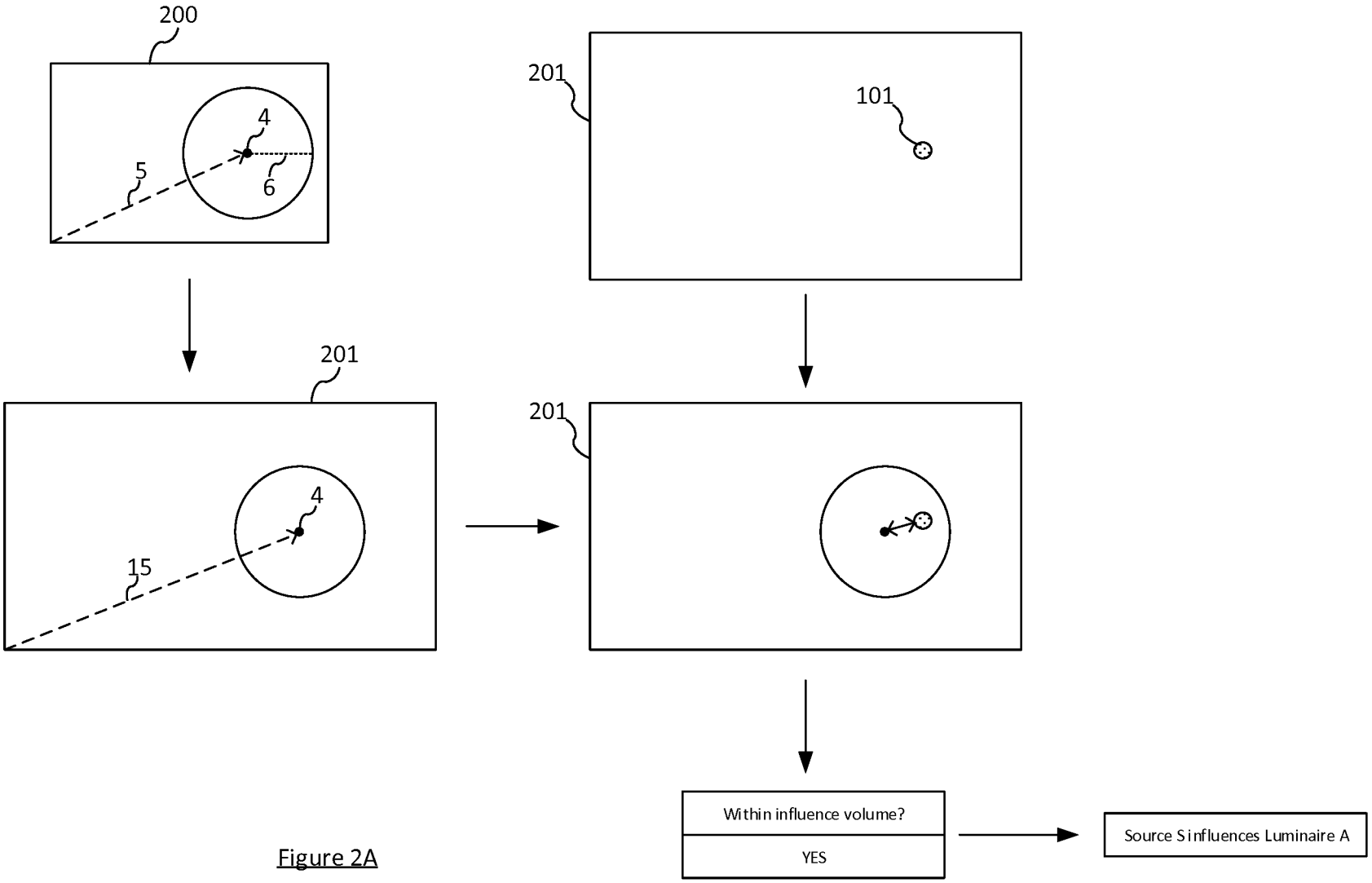
FIG. 2A shows how a virtual source is used to control a luminaire.
Figure 2B:
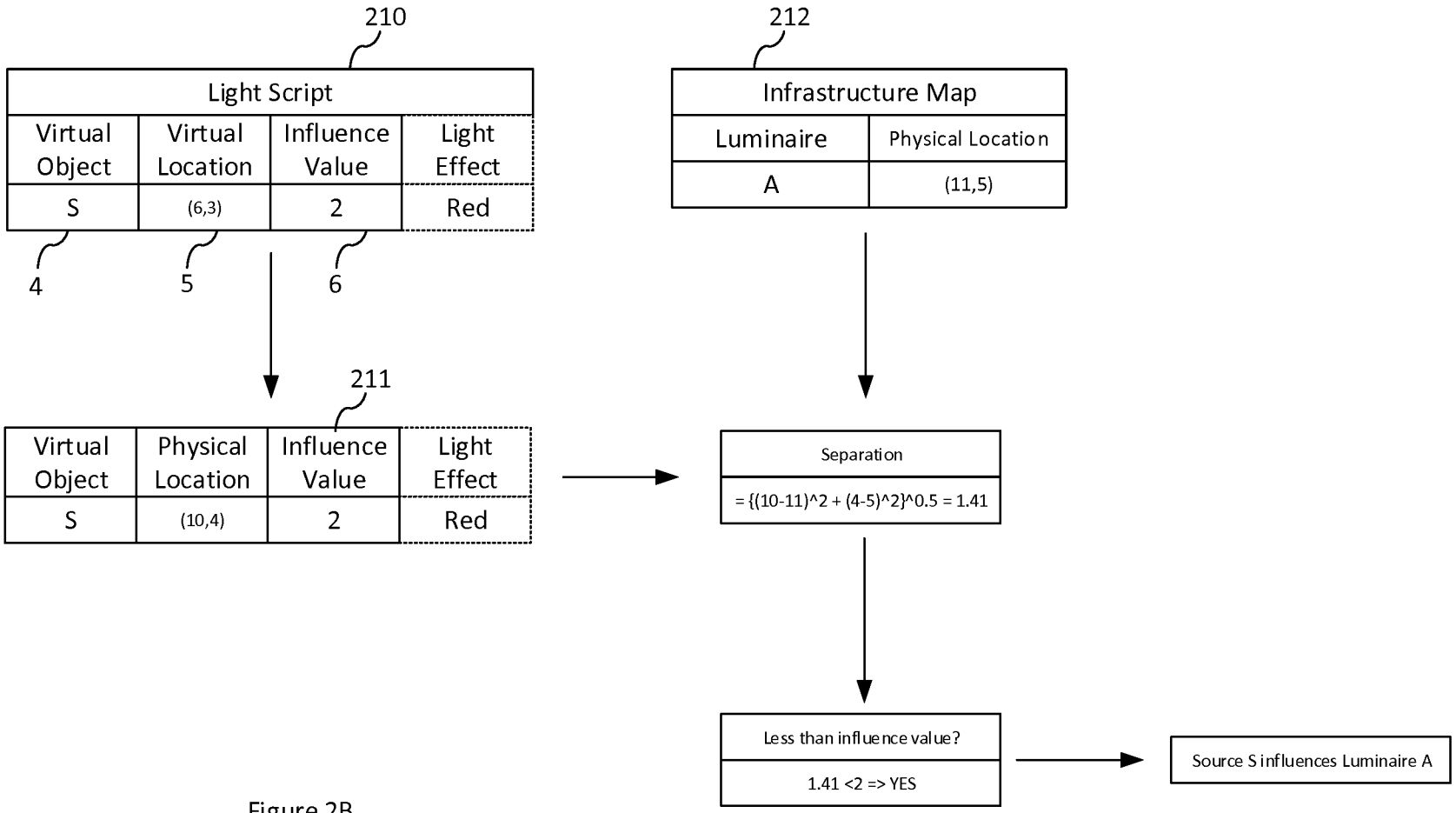
FIG. 2B shows an alternative representation of the method of FIG. 2A.

FIGS. 2A and 2B illustrate how a lighting script, which an abstract representation of a lighting scene, can be applied to a real-world (physical) lighting system. For simplicity, only a single virtual object and a single luminaire is considered in these example. The method is shown in FIG. 2A diagrammatically and in FIG. 2B as data structures (tables) corresponding to the diagrams in FIG. 2A.

A data object specifies a virtual object 4 in a virtual space 200. The virtual object 4 is at a virtual location within the virtual space as represented by coordinate vector 5. The virtual object 4 also comprises an influence value 6 which specifies an influence range which in the simplest cases can be visualized as in FIG. 2A as a radius in the virtual space.

A physical space map specifies the location of a luminaire 101 within a physical space 201. The physical space 201 is the real-world space in which the user's lighting system 100 is deployed (i.e. environment 103 from FIG. 1). Hence, the location of the luminaire 101 within the physical space 201 may be any suitable coordinate such as a coordinate relative to some real-world physical location, or on an "absolute" positioning scale such as a latitude/longitude value pair. It is noted and appreciated that the examples given herein are given in two dimensions for ease of visualization, but the principles apply equally to three dimensions. That is, for example, the location of the luminaire 101 could be specified in three dimensions e.g. as a latitude/longitude/altitude triplet. Other positioning methods and systems are well known.

The data object is transformed into the same real-world positioning scheme as that in which the luminaire 101 is specified. This may involve scaling, rotating, sheering, or otherwise transforming of the virtual space 200. This transformation may be specified by the user 309 e.g. using a graphical interface on the user device 311, or the controller can determine an appropriate transformation automatically (e.g. by maximizing the amount of the physical space which is covered by the transformed data object). In any case, the result is a "real-world" location for the virtual object. This is shown in FIG. 2A as the virtual object 4 being placed within the physical space 201. This is specified by a new vector coordinate 15 which is the original vector coordinate 5 transformed according to the transformation.

The physical locations of both the virtual object 4 and the luminaire 101 can be combined as shown in FIG. 2A to determine whether or not the luminaire 101 lies within the influence range of the virtual object's location. This is shown graphically in FIG. 2A and explained in more detail below in relation to FIG. 2B. If the luminaire 101 does fall within the influence range then the virtual source 4 will have an effect on the light output settings of the luminaire 101, as shown in FIG. 2A. If the luminaire 101 is outside the influence range, then the virtual source 4 will not have an influence on the light output settings of the luminaire 101.

In FIG. 2B the data object 210 is shown as a table specifying the virtual object 4 comprising a virtual location (denoted by a coordinate vector) and an influence value 6. The virtual object 4 also optionally comprises a lighting settings (e.g. an RGB value). In this example, the virtual object 4 is "red". That is, if the luminaire 101 is within the influence range of this virtual object 4, then the luminaire 101 will be controlled to output a red light effect.

Similarly, a lighting infrastructure map 212 specifies the location of the luminaire 101 within the physical space 201. This map 212 may be constructed by the user 309 (or a commissioner of the lighting system 100 during a commissioning process) by known methods which allow the locations of luminaires to be determined and recorded.

Table 211 shows the transformed version of the virtual object 4 which now comprises a physical location denoted by vector coordinate 15.

The separation between the luminaire 101 and the virtual object 4 within the physical space 201 can now be calculated. In the simplest cases, this separation is calculated as the Euclidean distance between the two points, as shown in FIG. 2A. The determined separation is then compared with the influence value 6 of the virtual object 4 to determine whether or not the luminaire 101 is within the influencing range of the virtual object 4, as above.

Figure 3:
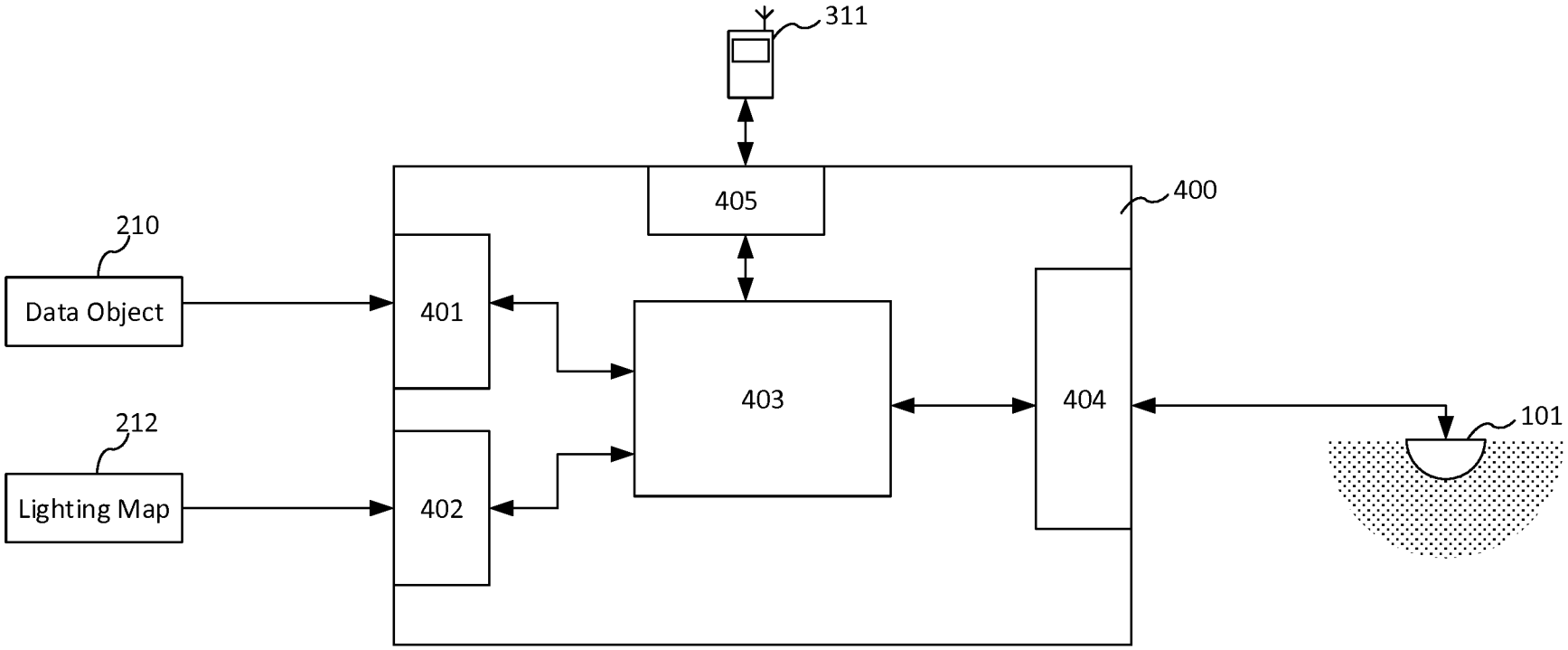
FIG. 3 is a block diagram of a control device according to embodiments of the present invention.

FIG. 3 illustrates a controller 400 in accordance with embodiments of the present invention. The controller 400 comprises a first input 401, a second input 402, a processor 403, and an output 404. The processor 403 is operatively coupled to each of the first input 401, second input 402, and the output 404.

The controller 400 may be implemented in the user device 311, the bridge 307, one of the luminaires 101 and perform the functionality described herein. Alternatively, the controller 400 may be implemented in a distributed manner, with some functionality being performed at one physical device of the lighting system (e.g. the user device 311, bridge 307, or a luminaire 101) and other functionality being performed at a different physical device. This different physical device may be a physical device present in the environment 103 (e.g. the user device 311, the bridge 307, or a luminaire 101) or may be a remote device such as a remote server accessible over the Internet 313.

The first input 401 is arranged to receive the data object 210 (described above). The data object 210 may be stored on an external memory such as memory 315 in which case the data object is received at the first input 401 via a network such as the Inter 313. Alternatively, the data object 210 may be stored on a local memory, internal to the controller 400.

The second input 402 is arranged to receive a lighting map 212 (described above). The lighting map 212 may be stored on an external memory such as memory 315 in which case the data object is received at the first input 401 via a network such as the Inter 313. Alternatively, the lighting map 212 may be stored on a local memory, internal to the controller 400.

The processor 403 is arranged to receive the data object 210 via the first input 401, and to receive the lighting map 212 via the second input 402. The processor 403 is further arranged to process the received data object 210 and lighting map 212 in accordance with methods described herein to generate lighting control commands for at least one luminaire 101.

The output 404 is for at least sending data to, and optionally receiving data from, the at least one luminaire 101 in accordance with known lighting control protocols. The processor 403 is arranged to transmit at least one generated lighting control command to the at least one luminaire 101 and hence control at least one characteristic of the light emitted by the luminaire in accordance with the lighting control commands.

The processor may also be arranged to receive input from the user 309 via a user device 311 (or other computing device) via a third input 405, as shown in FIG. 3. This is described in more detail below.

In the most general terms, the processor 403 is arranged to receive the data object (which specifies at least one virtual object being at a virtual location, and having an influence value), determine a physical location of a luminaire 101, determine a separation between the physical location of the luminaire and a physical location corresponding to the virtual location of the virtual object, and control the luminaire 101 based on a function of both the separation and the influence value.

Figure 4A:
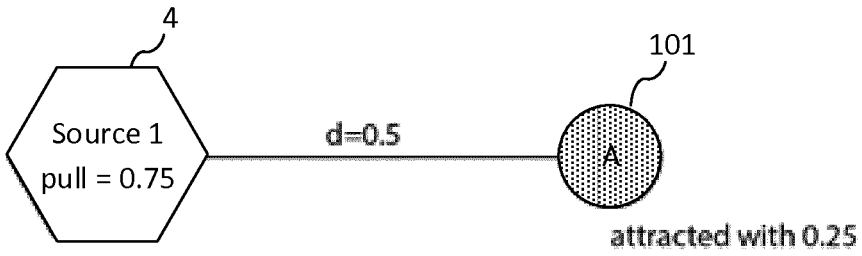
FIGS. 4A-C show examples of variations in lighting effects.
Figure 4B:
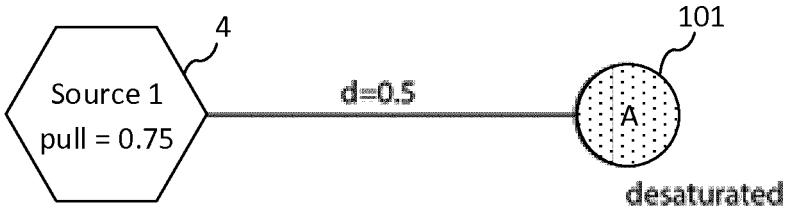
Figure 4C:
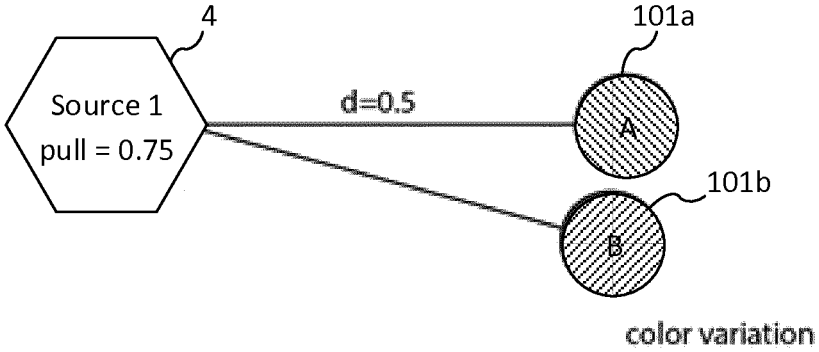

There are several ways in which this function may be implemented, examples of which are shown in FIGS. 4A-4C. The function may output a factor (e.g. multiplication factor) to be applied to a parameter of the virtual object's state. For example, if the virtual object 4 has a light state (i.e. lighting setting) of an RGB value such as #FF0000 (red), then the function can be applied to this value by multiplying some or all of this value by the function value at the determined separation value. E.g. if the function is 0.5 (50%) then the red setting given above would be reduced to #7E0000. It is appreciated that the function can also be applied to components of the RGB space (such as only the red channel for example), and that the function can also be applied to different color spaces (e.g. YUV) or parts thereof.

Figure 5A:
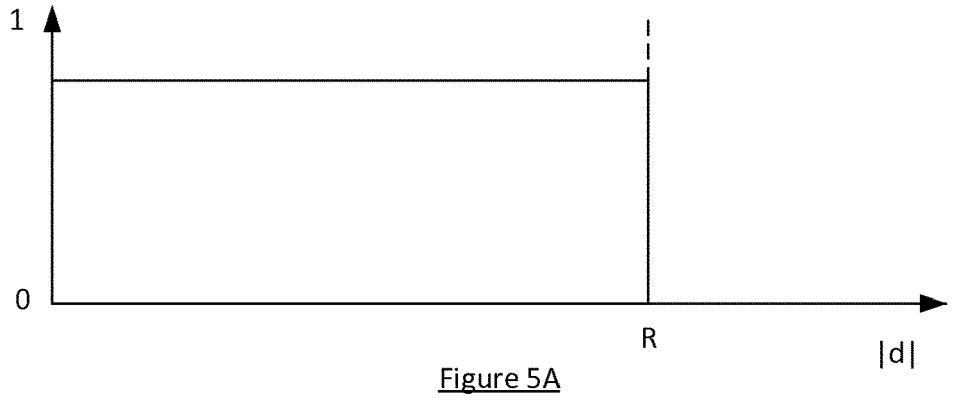
FIGS. 5A-D show examples of functions for use in embodiments of the present invention.

FIG. 4A shows luminaire A (i.e. e.g. luminaire 101*a*) with a distance of 0.50 to source 1 (i.e. a virtual object 4). The pull factor (i.e. influence range) is 0.75, which is higher than the distance so the light is attracted to the light state of source 1. In this example, the function mentioned above is a step function having a value of zero for |distance|>pull factor, and a non-zero value elsewhere. This function is shown in FIG. 5A.

Figure 5B:
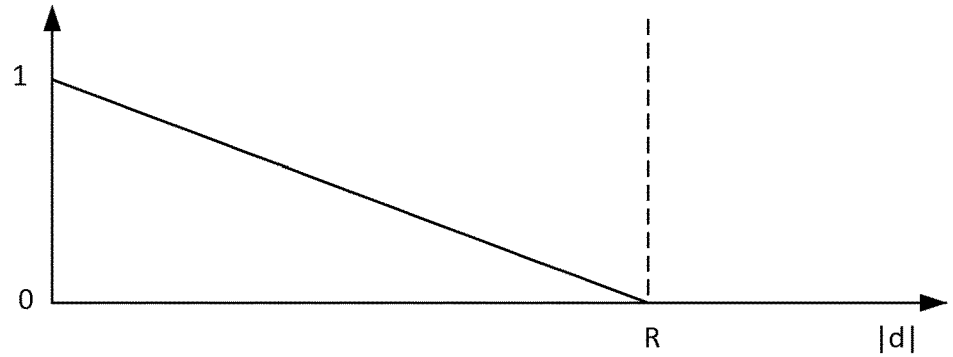
Figure 5C:
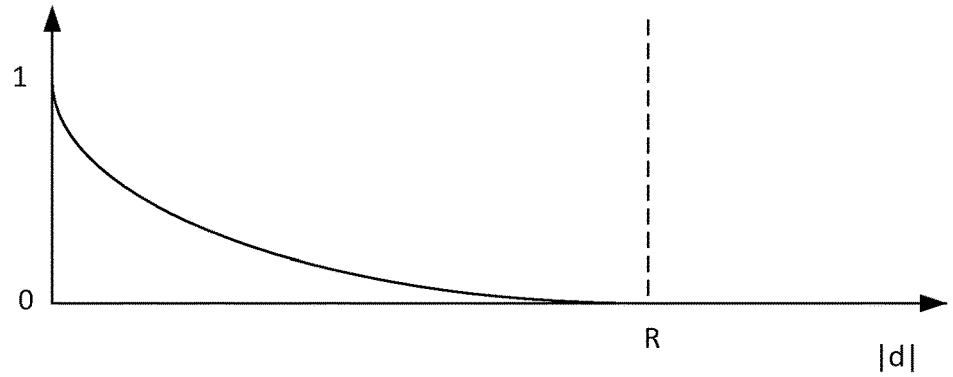
Figure 5D:
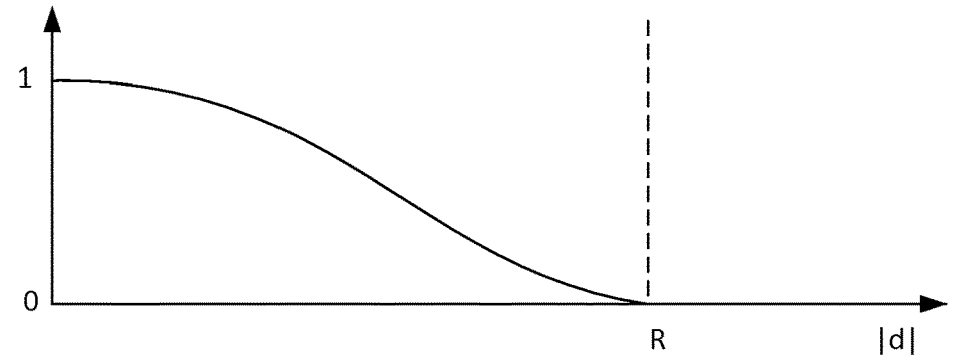

In the example of FIG. 4B, the light state of luminaire A is altered based on the distance to the virtual object 4. For example by adjusting the brightness or saturation of the light output of luminaire A based on the distance from the source (e.g. luminaires further away are dimmed or are desaturated, or vice-versa). In this example, the function is again zero for |distance|>pull factor, and then increasing (e.g. linearly, logarithmically etc.) for decreasing |distance|. FIG. 5B shows the shape of the linear function. FIGS. 5C and 5D show further examples in which the function is non-linear. It is understood that the choice of function is dependent on the particular lighting system and user preferences. For example, the function of FIG. 5D results in less variation around small distances then the function of FIG. 5C, which may be preferable in some circumstances. It is appreciated that in some or all of the example functions (particularly those of FIGS. 5C and 5D), the function may be non-zero outside of|distance|>influence range. That is, in general the influence range is just a parameter of the function which defines a characteristic behavior.

An extension to this is that the source may specify a variation parameter for the light state. This parameter determines how much variation is tolerated for luminaires that are attracted to that source. For example, the light state of the source may define a xy-color parameter, but with a variation of 0.05. This means that lights that are further away from the source may have slightly different color tones as the main color. In other words, the variation parameter acts in the same way as the example given above in relation to FIG. 4B. However, instead of e.g. desaturating the color or reducing the brightness, the actual color tone (hue) is changed. This means that the variation parameter can be an amount of a particular hue to add based on distance. For example, a source might be "red" but with a variation parameter specifying "orange" in which case luminaires close to the source will be red, but luminaires further away will be increasingly orange with distance. This can be achieved using a weighting between RGB color values between the two extremes (red, orange) over distance. Or, luminaires close to the source adopt the true color of the source, and luminaires further away adopt the color of the source±(the variation value*distance).

The alteration of the lighting output of a luminaire 101 may depend on other factors in addition to the separation between it and a virtual object 4. For example, In circumstances where there are multiple luminaires 101*a*, 101*b* within influence range of a single virtual object 4, the respective lighting setting of each luminaire 101*a*, 101*b* may be varied based on the density of luminaires around the source. In this example, the variation can be:

The first luminaire adopts the actual color of the source.

A second luminaire adopts the color of the source± (variation parameter*(n*1/number of lights), where n=1

A third luminaire adopts the color of the source±(variation parameter*(n*1/number of lights), where n=2

For luminaire 3, n=3 Etc.

In other words, if there are for example three luminaires within range of a source, the first, second, and third luminaires will adopt slightly altered versions of the source color. In the example formulation given above, the more densely the area is populated with lights, the more variation of colors exhibited by the luminaires.

Figure 6A:
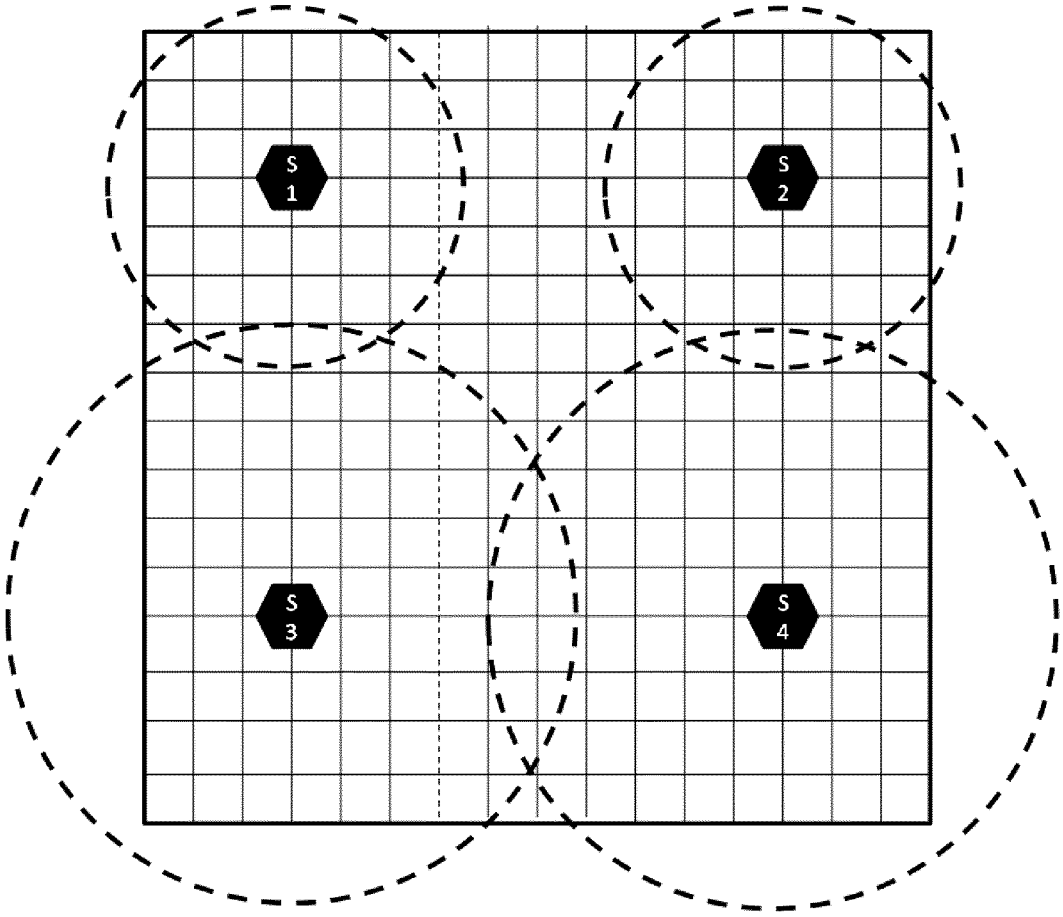
FIGS. 6A-C illustrate the application of multiple virtual sources to multiple luminaires.
Figure 6B:
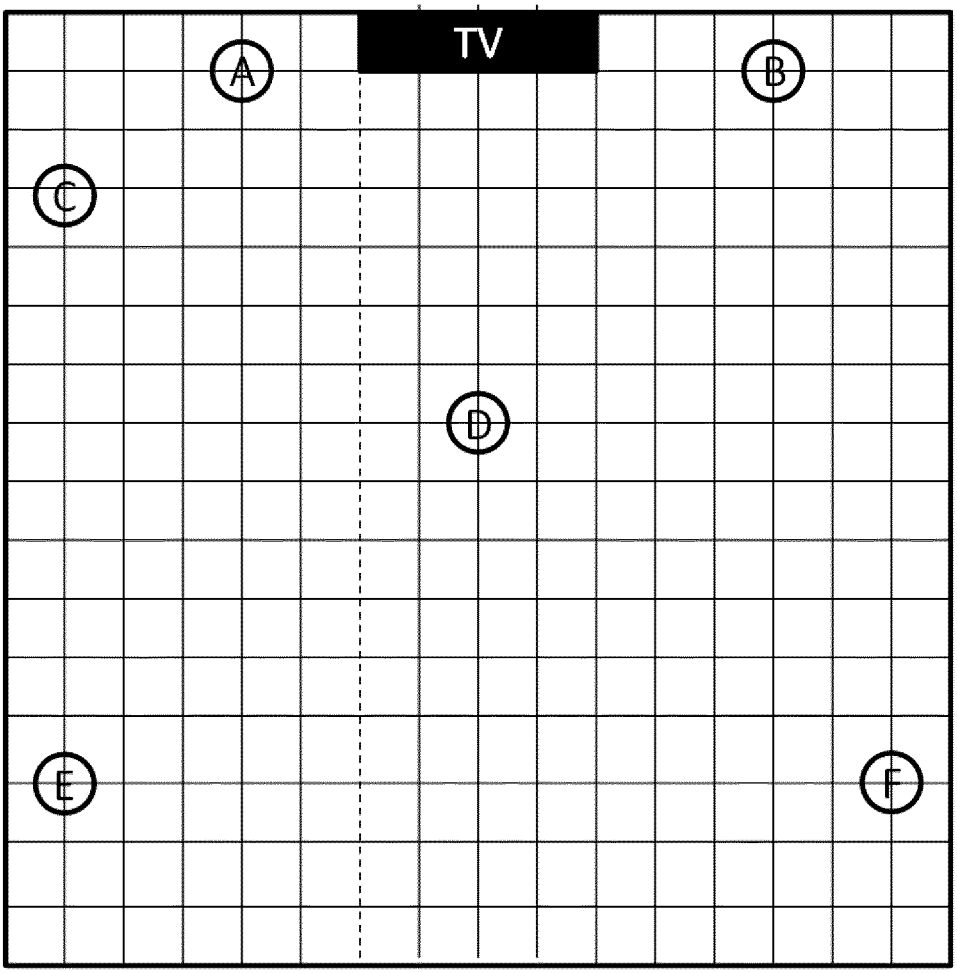
Figure 6C:
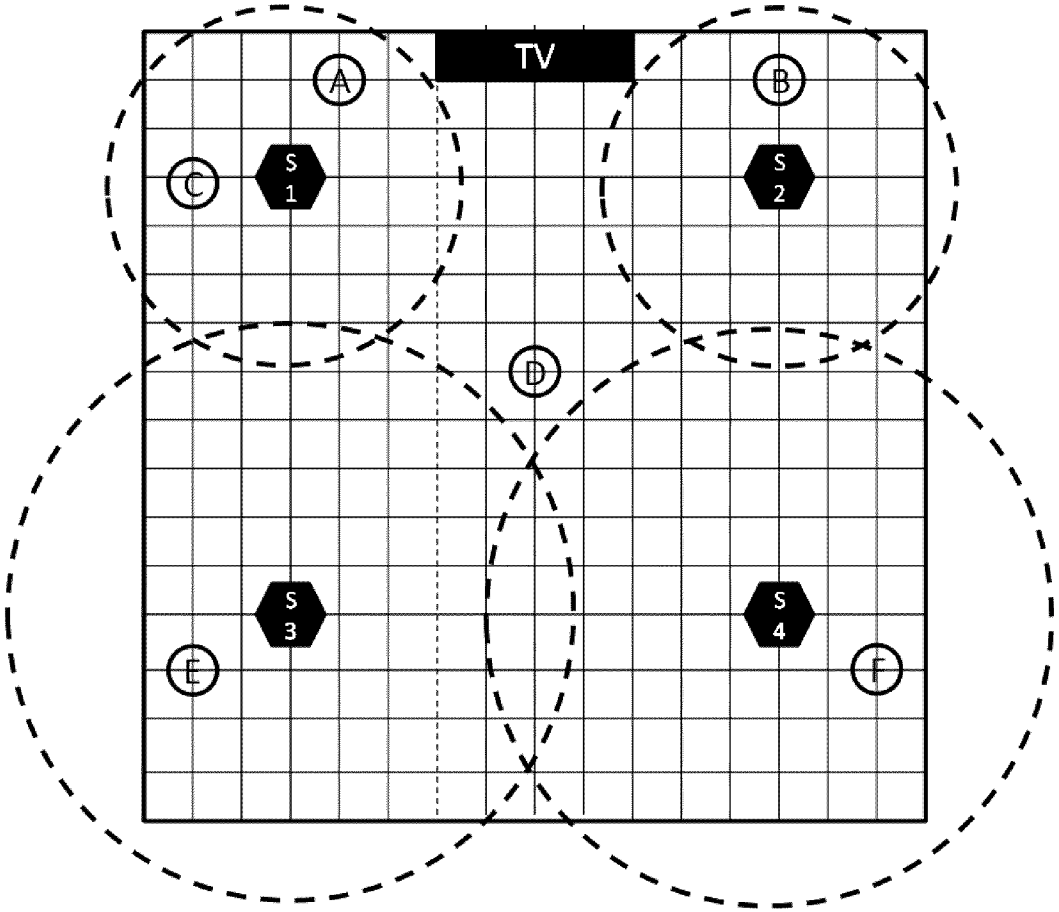

FIGS. 6A-C show a more complex example than that of FIGS. 2A and 2B. In this example, there are four virtual sources S1-S4, and six luminaires A-F.

The virtual locations of the virtual objects 4 are specified in data object 210, along with the influence value of each virtual object 4. A light effect is also associated with each virtual object 4. In this example, each virtual object 4 is associated with a different color. This is also shown diagrammatically in FIG. 6A (as above in FIG. 2A). For simplicity, the mapping from virtual space to physical space in this example is the identity mapping. I.e. the virtual space and physical space are directly comparable; virtual locations can be directly mapped onto physical locations without the need for a transformation (or, equivalently, the identity transformation is applied).

The physical locations of the luminaires 101 are specified in the infrastructure map 212 as shown in FIG. 6B both as a table and diagrammatically. Note that other devices may be present in the physical space such as a TV shown in FIG. 6B. If these are not part of the lighting system however they need not be present in the infrastructure map 212.

FIG. 6C shows how the locations of the virtual sources 4 fall within the physical space and therefore how they relate to the locations of the luminaires 101. Table 600 shows the separation value between each pair of virtual source 4 and luminaire 101, as determined by the processor 403. Separation values which are below the influence value for that particular virtual source 4 are highlighted. Hence, it is readily appreciated that luminaire A is within range of source S1, B within S2, C within S1, E within S3, and F within S4 and will be affected by these sources accordingly (as described above).

Luminaire D does not fall within range of any virtual source. In these cases (when a luminaire 101 is not affected by any virtual source 4), the luminaire 101 will not adopt any state (i.e. it will be in the OFF state), or alternatively be set to a default state (which could be the OFF state, but may also be an ON state such as a low brightness value on a default color).

Figure 7:
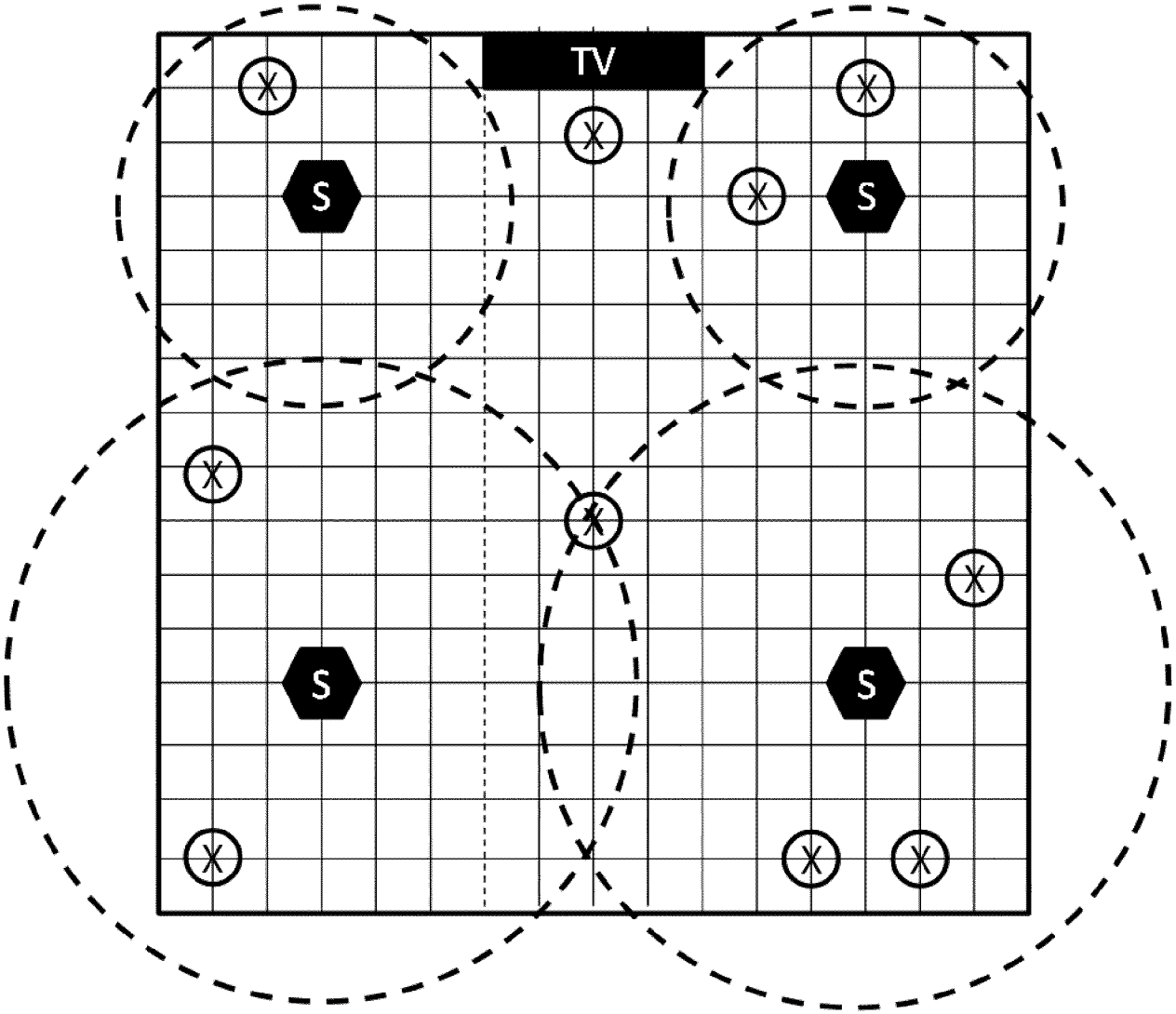
FIG. 7 illustrates an example in which multiple luminaires are influenced by a single virtual source.

FIG. 7 shows the same data object 210 from FIG. 6A as applied to a different lighting system (e.g. a lighting system owned or operated by a person other than user 309. In this example, one luminaire 101 falls within range of two virtual objects 4. This means that both source S3 and S4 are trying to influence the light output of luminaire 101. This may result in a conflict which can be resolved in one of two main ways. Firstly, the setting for the luminaire 101 can be a mixture of the states of each of the influencing sources, as in FIG. 8A. Secondly, the setting for the luminaire 101 can be only the result of a single one of the influencing sources, as decided by a rule such as those given in FIGS. 8B-C.

Figure 8A:
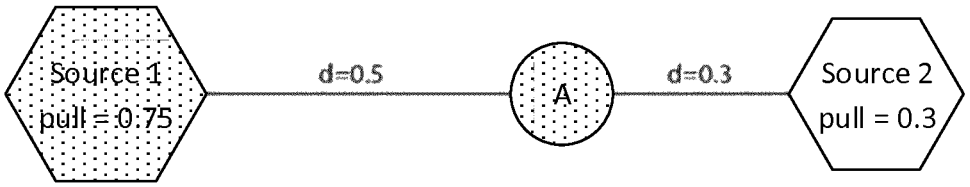
FIGS. 8A-C show examples of conflict resolution.

In FIG. 8A, luminaire A is within range of both source 1 (red) and source 2 (blue). In this example, the settings of both sources are mixed depending on the distance of the luminaire 101 to the source and the pull factor. By mixing the colors it is possible to create gradients through the physical space.

Figure 9A:
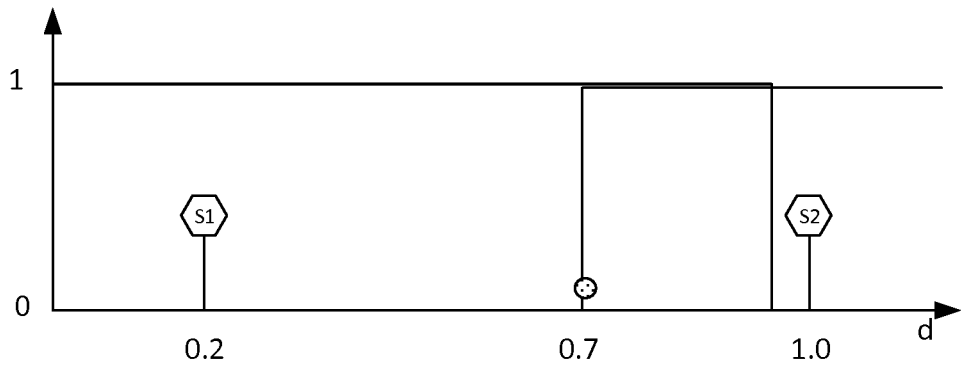
FIGS. 9A-B show examples of multiple functions.
Figure 9B:
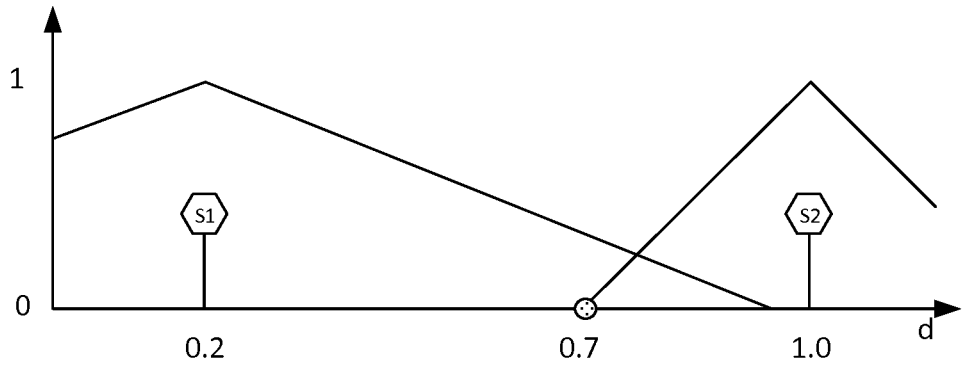
Figure 10A:
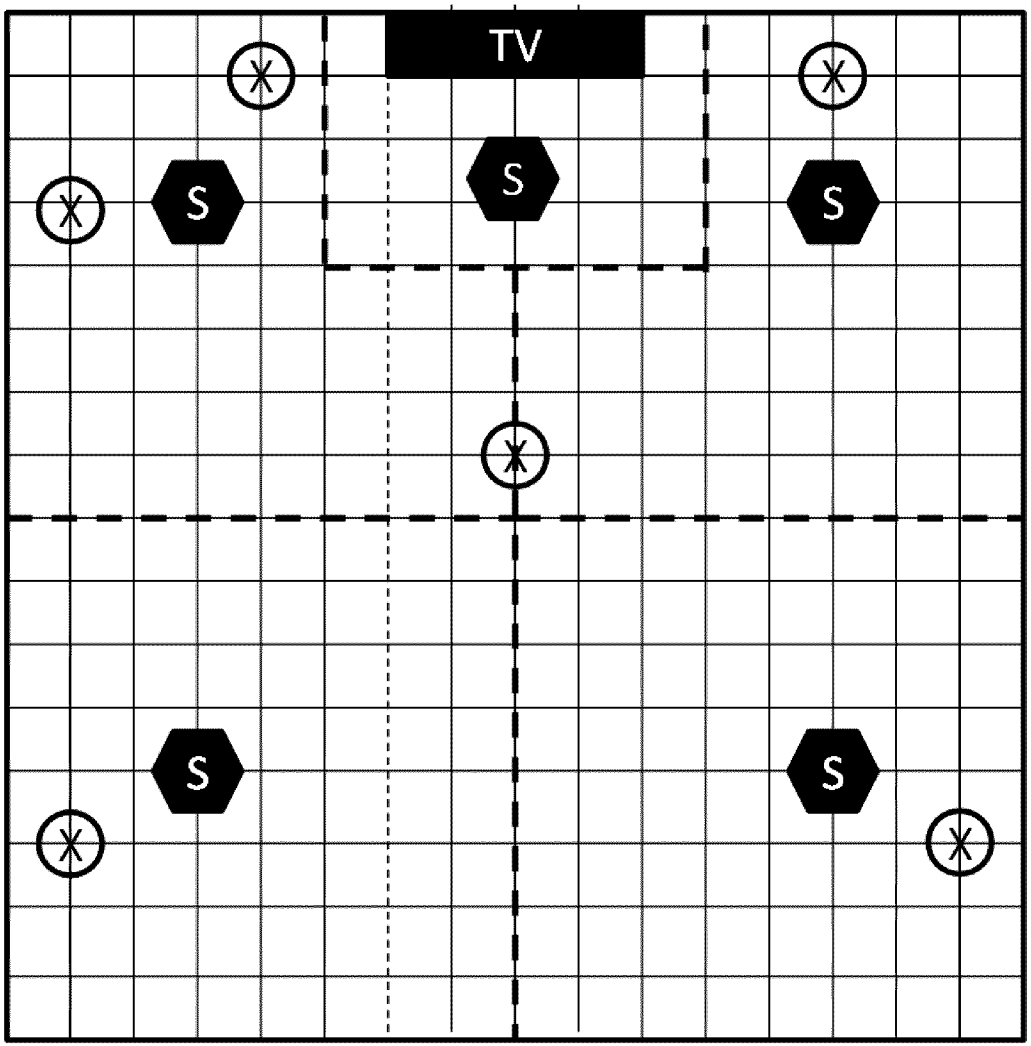
FIGS. 10A-F show various examples of virtual sources of different shapes.
Figure 10B:
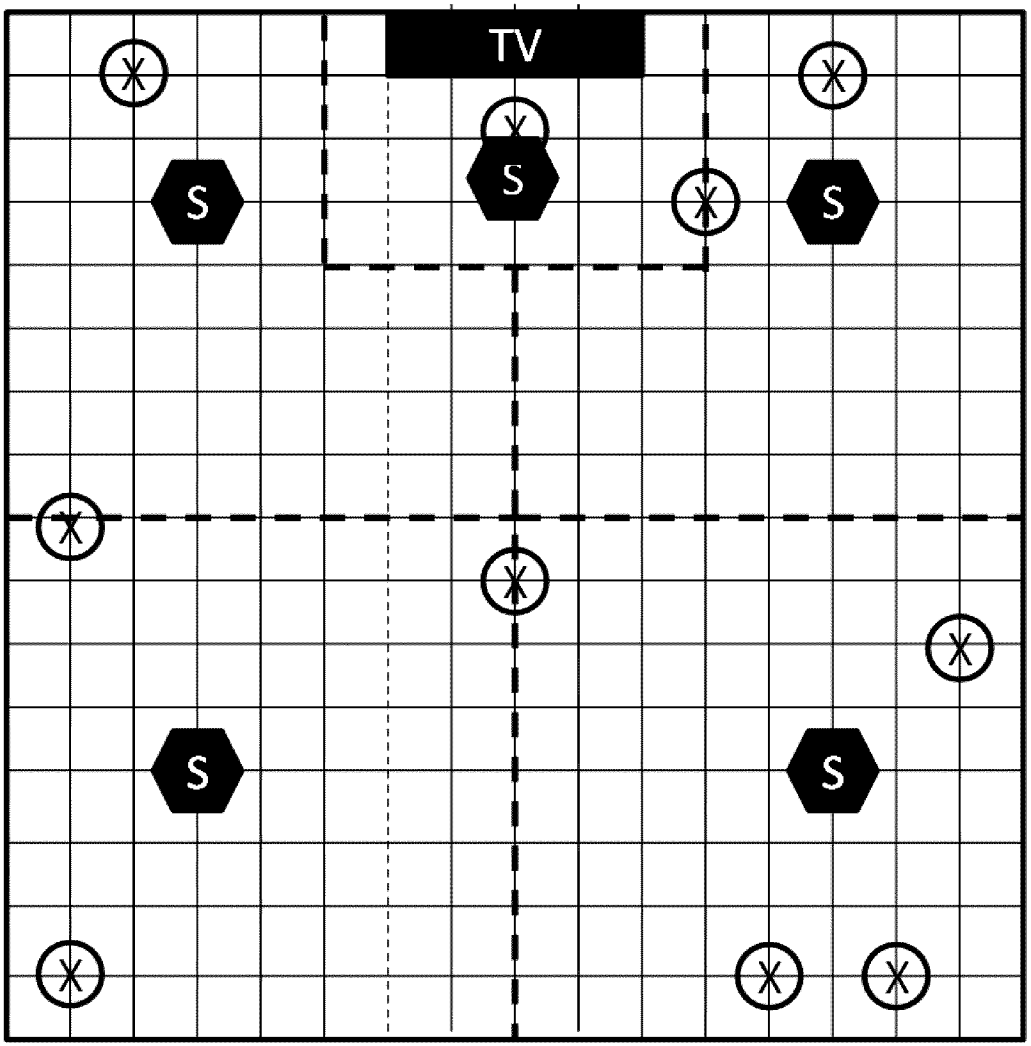
Figure 10C:
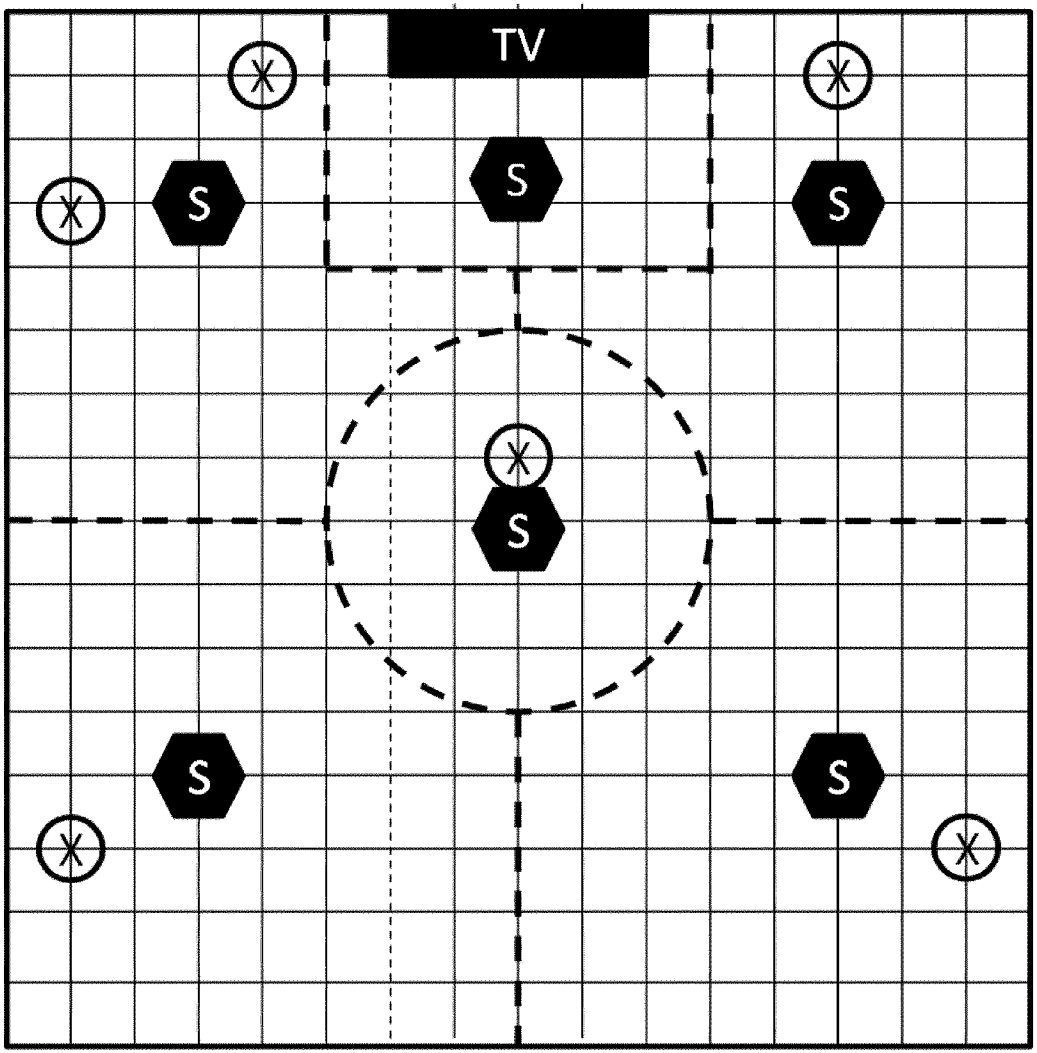
Figure 10D:
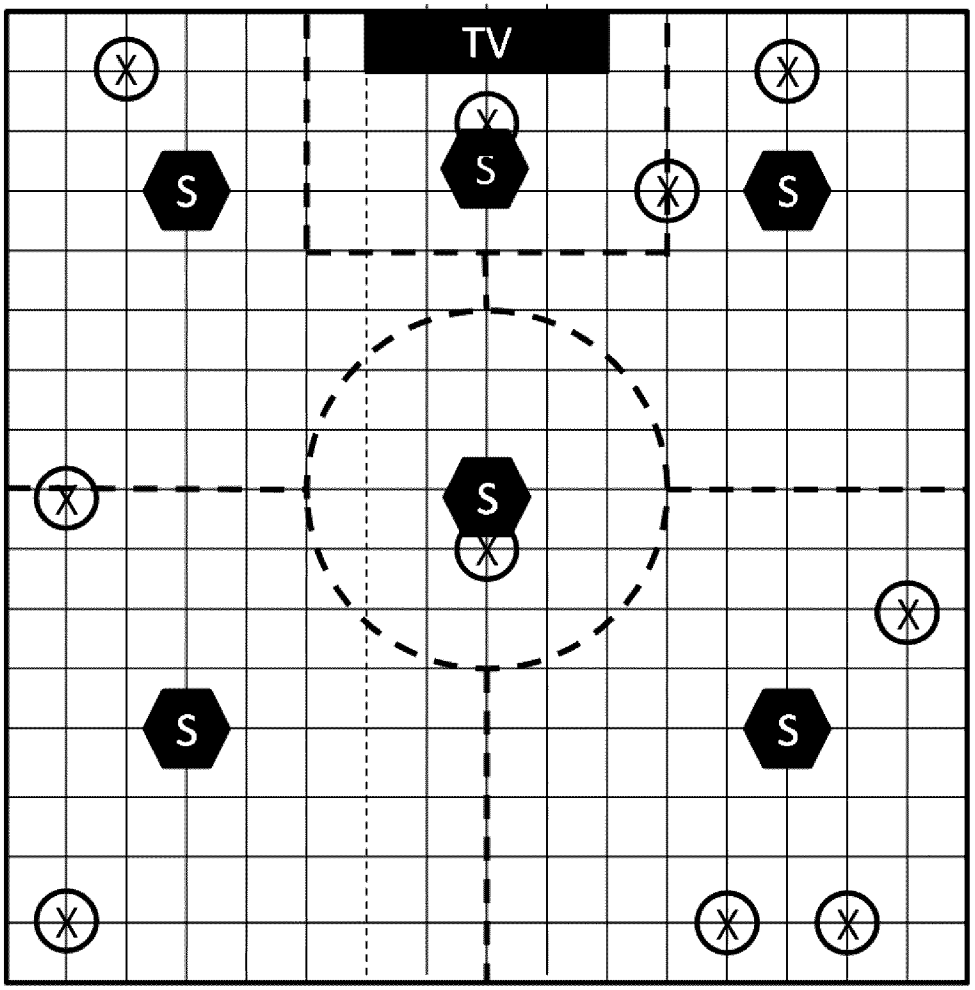
Figure 10E:
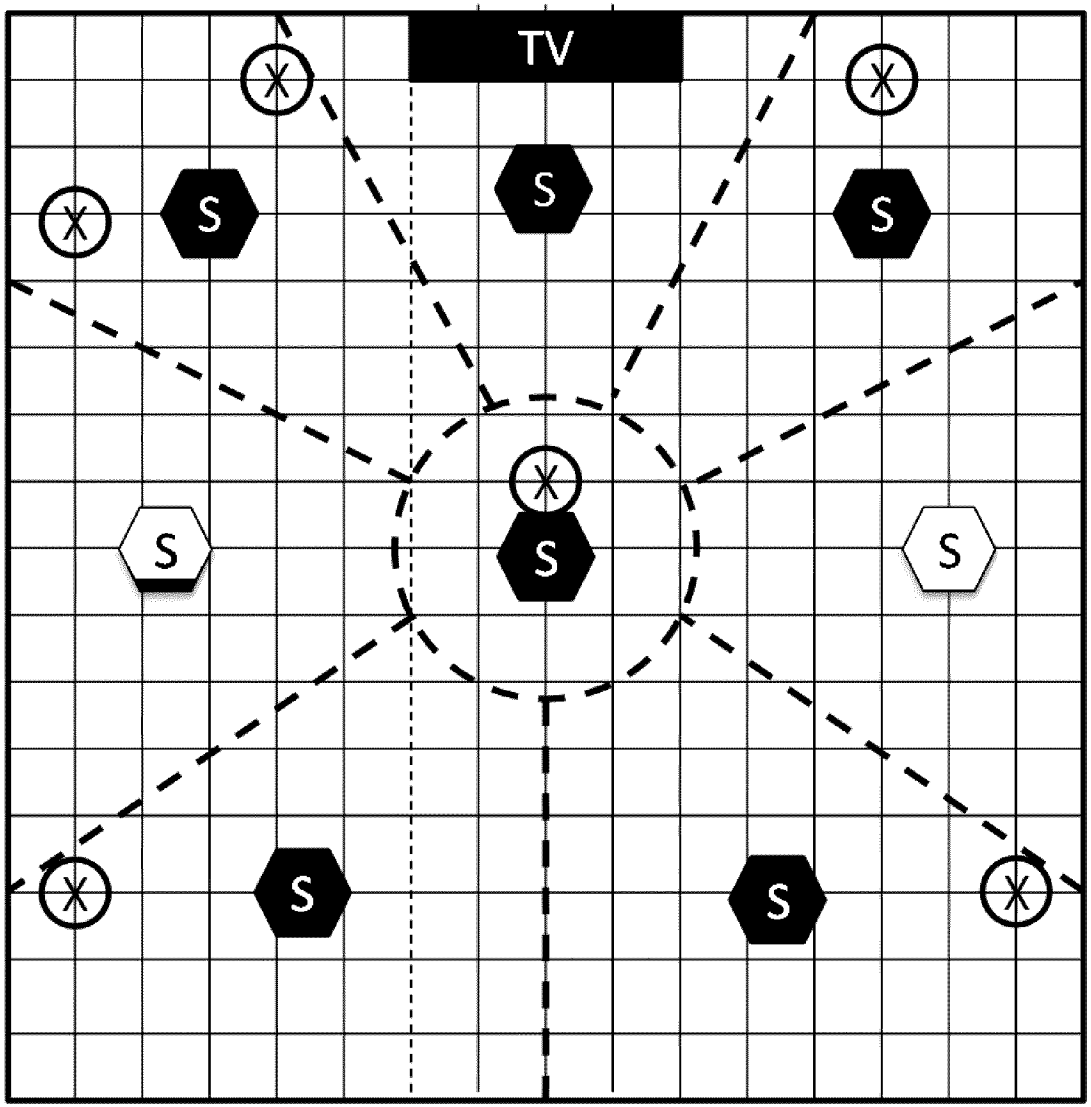
Figure 10F:
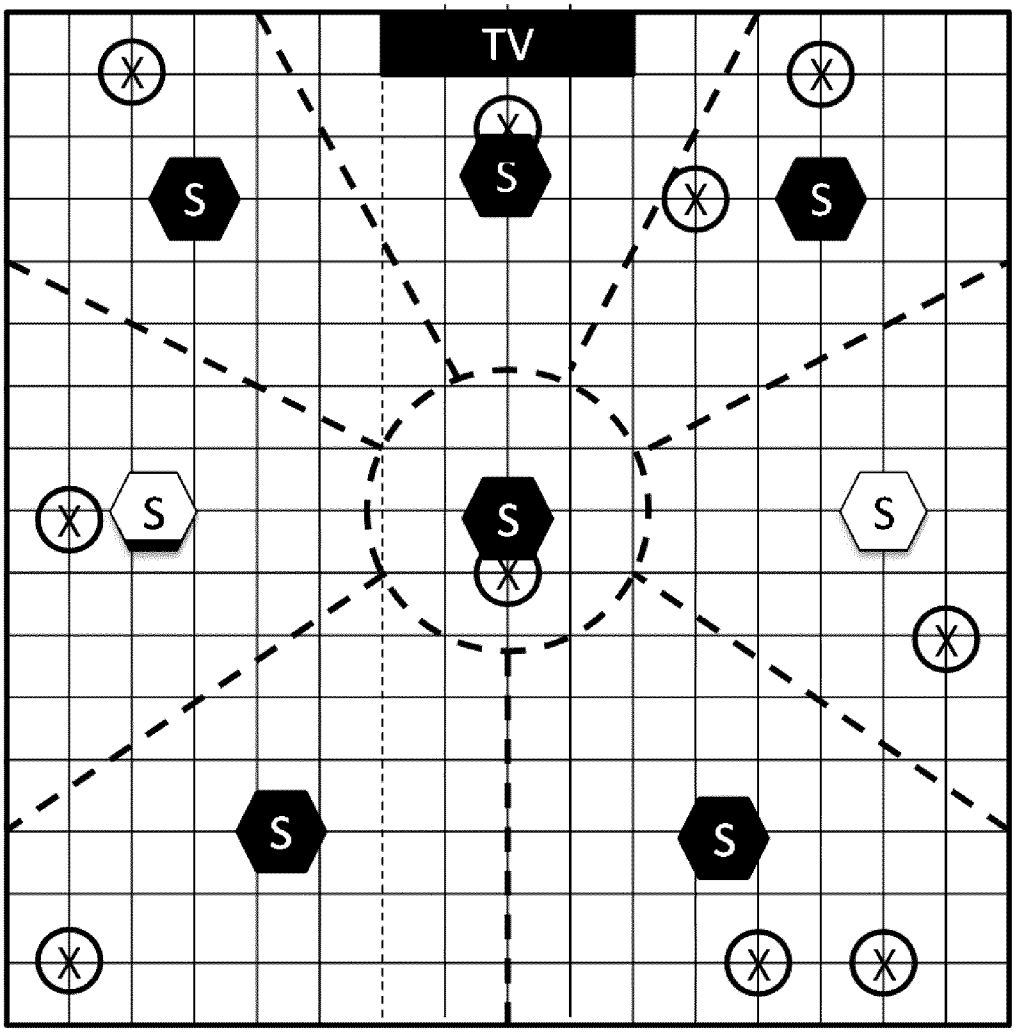

A simple example is shown in FIG. 9A. The luminaire 101 is within range of both source S1 and source S2. This means that the processor 403 is tasked with simultaneously controlling the luminaire 101 to render the lighting state of S1 and S2, as shown by the functions for each of S1 and S2 being equal to one at the location of the luminaire. In this example, the processor 403 controls the luminaire 101 to emit light having a property at a midpoint, combination, or superposition of the states of each source. E.g. if the state of S1 is #FF0000 and the state of S2 is #008800, the processor 403 may control the luminaire 101 to emit light with RGB=#FF8800. FIG. 9B shows another example in which the function for each luminaire varies linearly with position (d). Hence, it is understood that the value of the two functions at the luminaire location may be different. In this case, it may be preferable for the processor 403 to determine a setting for the luminaire 101 as a weighted average of the source states. It is appreciated that the functions for each source may not exhibit the same behavior (e.g. the function for S1 may be a step function and the function for S2 may vary linearly with position). It is also appreciated that the principles described above are easily extended to three or more sources (e.g. a weighted average of three source states).

Mixing colors in the manner described above in relation to FIG. 8A may lead to undesired results as colors may be created that have no relationship to the intention of the script designer (e.g. the midpoint of two sources which are blue and red may be a purple hue, even though the designer who first specified the lighting script with these sources may have not intended for any purple to be present in the rendered lighting scene). Alternatively, if the mixing is done as a superposition mixing two colors is likely to result in a white color. This may also not be intended by the designer of the lighting script. In these cases, it may be preferable to choose a "winner" of the two sources which gets to influence the luminaire 101 entirely (and the other source is ignored). The luminaire 101 then fully adopts the lighting state of the winning source 4.

Figure 8B:
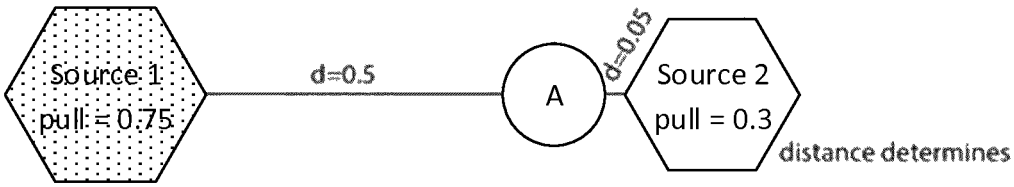

In a first example, as shown in FIG. 8B, source S1 has a pull of 0.75 and source S2 has a pull of 0.30. The source 4 with the highest pull factor at the location of the luminaire 101 wins.

Similarly, the amount by which a luminaire 101 is within the respective influence range of a source 4 can be used (the highest being the winner). In this case, luminaire A has a distance of 0.5 to source S1 and a distance of 0.3 to source S2 and therefore luminaire A will adopt the settings of source S1, because it is 0.25 (=0.75−0.50) within the influence range of source S1, and 0.0 (0.30−0.30) within that of source S2. Even though the light point is closer to source S2, it is still attracted to the state of source S1.

This can still result in conflicts in cases where a luminaire 101 is within range of two sources 4 by the same amount. For example, if the distance of source 2 would be reduced to 0.05, both would attract Light point A with 0.25. In a second example, as shown in FIG. 8C, the source with the highest influence value wins the tie-break.

Figure 8C:
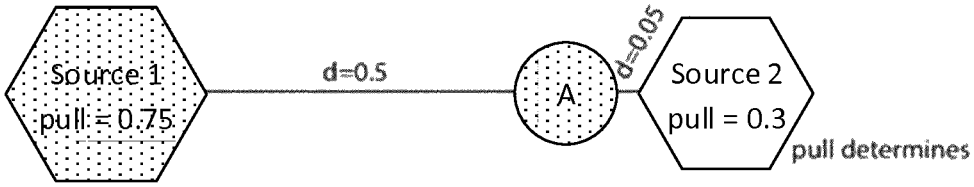

The rang-based tie break method of FIG. 8C could be used as the main method, and the distance-based method of FIG. 8B could be used as the tie-break. Which of these is used depends on the preferences of the user and/or lighting script designer. That is, the user 309 can specify his preference by providing it to the processor 304 e.g. using his user device 311, or the script designer can select whether the highest pull factor, or the smallest distance should determine the final light state when designing the lighting script. This is then stored along with the lighting script and used by the processor 403 in determining the lighting settings for the luminaire 101.

The methods described herein can be extended to dynamic lighting scenes (i.e. lighting scenes which not only specify lighting settings for luminaires 101 in the physical space 201 but also specify temporal changes to those lighting settings).

In these cases, the data object additionally specifies one or more motion parameters which determine a motion of each virtual object through the virtual space. Thus, as the controller 400 applies the lighting script, the virtual objects' locations within the physical space will vary over time and thus which luminaires 101 are within range of each virtual source 4 will also change over time, thus rendering a dynamic lighting effect. The methods may also be applied to compensate for dynamic effects. For example, one of the luminaires 101 that are closer to the source 4 may be more 'responsive' to dynamic setting changes, whereas other ones of the luminaires 101 further away from the source 4 respond slower and more fluently to changes on light states. That is, the function defines a variation in at least one timing parameter of dynamics.

The function may also specify an amount of time for which a given lighting setting is to be rendered by the luminaire 101.

The function may also specify a rendering mode for the luminaire 101.

Further, it is appreciated that the influence range has been described with reference only to a circular (in 2D) or spherical (in 3D) influence range, wherein the influence value is a single (scalar) number indicating the radius of the influence range, but other shapes (volumes) are possible. For example, squares (cubes), rectangles (cuboids) or ellipses (spheroids) may allow more freedom to the lighting script designer. Examples are shown in FIGS. 10A-F. In these examples, the influence value may comprise one or more individual parameters (e.g. a height, length and width for a cuboid, or a semi-major and semi-minor axis for an ellipse).

It will be appreciated that the above embodiments have been described only by way of example. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored and/or distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A method of controlling a luminaire at a first physical location in a physical space to render a lighting effect in the physical space, the method being performed by a control device and comprising steps of:

receiving at least one data object for use in rendering the lighting effect, the data object defining at least one virtual object comprising an influence value for the virtual object and a coordinate vector denoting a virtual location of the virtual object in a virtual space;

determining the first physical location of the luminaire in the physical space from a map of the physical space;

determining a separation between the first physical location of the luminaire and a second physical location in the physical space corresponding to the virtual location of the virtual object in the virtual space; and controlling at least one characteristic of light emitted by the luminaire as a function of the determined separation and the influence value for the virtual object, thereby rendering the lighting effect.

2. The method according to claim 1, further comprising a step of mapping the virtual location denoted by the coordinate vector of the virtual object to the second physical location within the physical space.

3. The method according to claim 1, wherein the influence value is an influence radius and said function varies between a maximum at zero separation and zero at separation equal to the influence radius.

4. The method according to claim 1, wherein said at least one characteristic is one or more of a brightness or saturation of the light emitted by the luminaire.

5. The method according to claim 1, wherein the data object defines:

a first virtual object comprising a first influence value for the first virtual object and a first coordinate vector denoting a first virtual location of the first virtual object in a virtual space; and a second virtual object comprising a second influence value for the second virtual object and a second coordinate vector denoting a second virtual location of the second virtual object in the virtual space.

6. The method according to claim 5, wherein said determining a separation comprises determining a respective separation for each of the first and second virtual objects; and said controlling is performed as a function of the determined separations, the first influence value, and the second influence value.

7. The method according to claim 6, further comprising determining a winning virtual object according to a predetermined rule; and wherein said controlling is performed based only on the respective separation and influence value for the winning virtual object.

8. The method according to claim 7, wherein the predetermined rule is that the winning virtual object is a one of the first and second virtual objects having a highest function value at the physical location of the luminaire.

9. The method according to claim 7, wherein the predetermined rule is that the winning virtual object is a one of the first and second virtual objects having the highest respective influence value.

10. The method according to claim 1, wherein the at least one characteristic is at least one of a brightness, saturation, hue, or timing of a dynamic effect.

11. The method according to claim 1, further comprising performing the method steps to control at least one further luminaire at a respective further physical location in the physical space to render a further lighting effect in the physical space.

12. The method according to claim 11, wherein the at least one characteristic is varied based on a number of luminaires within range of the virtual source.

13. A control device for controlling a luminaire at a first physical location in a physical space to render a lighting effect in the physical space, the control device comprising:

an output for sending control commands to the luminaire;

a first input for receiving at least one data object for use in rendering the lighting effect, the data object defining at least one virtual object comprising an influence value for the virtual object and a coordinate vector denoting a virtual location of the virtual object in a virtual space; and a processor arranged to:

determine the first physical location of the luminaire in the physical space from a map of the physical space;

determine a separation between the first physical location of the luminaire and a second physical location in the physical space corresponding to the virtual location of the virtual object in the virtual space; and control, via the output at least one characteristic of light emitted by the luminaire as a function of the determined separation and the influence value for the virtual object, thereby rendering the lighting effect.

14. A lighting system comprising the control device of claim 13 and the luminaire.

15. A computer program product comprising computer-executable code embodied on a non-transitory computer-readable storage medium arranged so as when executed by one or more processing units to perform the method according to claim 1.

* * * * *